US005577357A

United States Patent [19]

Civelli

[11] Patent Number: 5,577,357

[45] Date of Patent: Nov. 26, 1996

[54] HALF LOG SIDING MOUNTING SYSTEM

[76] Inventor: Ken Civelli, 56 Underhill Ave. 2A, White Plains, N.Y. 10604

[21] Appl. No.: 499,818

[22] Filed: Jul. 10, 1995

[51] Int. Cl.[6] ..... E04B 1/10

[52] U.S. Cl. ..... 52/233; 52/586.2; 52/591.4; 52/520; 52/546; 52/551

[58] Field of Search ..... 52/233, 586.2, 52/586.1, 582.1, 543, 539, 546, 520, 547, 551, 745.1, 747.1, 748.11, 591.4

[56] References Cited

U.S. PATENT DOCUMENTS

| | | | |
|---|---|---|---|
| 1,986,739 | 1/1935 | Mitte | 52/591.4 |
| 2,099,632 | 11/1937 | Starr | 52/591.4 X |
| 2,276,071 | 3/1942 | Scull | 52/591.4 |
| 2,354,639 | 7/1944 | Seymour | 52/55 X |
| 2,463,612 | 3/1949 | Grudda | 52/233 |
| 2,498,551 | 2/1950 | Jonsrud | 52/233 |
| 3,237,360 | 3/1966 | Mills | 52/546 X |
| 4,012,876 | 3/1977 | Grubbs | 52/233 |
| 4,277,925 | 7/1981 | Kinser | 52/233 |
| 4,356,676 | 11/1982 | Hauptman | 52/233 X |
| 4,592,182 | 6/1986 | Felser | 52/233 |
| 4,640,069 | 2/1987 | Felser | 52/233 |
| 4,951,435 | 8/1990 | Beckedorf | 52/233 |
| 4,967,526 | 11/1990 | Yost | 52/233 |
| 5,010,701 | 4/1991 | Halsey, Jr. et al. | 52/233 |
| 5,020,289 | 6/1991 | Wrightman | 52/233 |
| 5,060,432 | 10/1991 | Christian | 52/233 |
| 5,161,519 | 11/1992 | Christian | 52/233 X |
| 5,277,008 | 1/1994 | Saulez | 52/233 |
| 5,423,153 | 6/1995 | Woolems et al. | 52/233 |

FOREIGN PATENT DOCUMENTS

| | | | |
|---|---|---|---|
| 002017657 | 10/1992 | WIPO | 52/233 |

*Primary Examiner*—Robert Canfield
*Attorney, Agent, or Firm*—Morrison Law Firm

[57] ABSTRACT

A system of and manner for applying half log siding to a pre-constructed wall with the use of a separate piece of interlocking material. Having a specific shape, this interlocking piece allows for easy assembly and will securely hold the bottoms and tops of the positioned half logs to the wall. This assembly is repeated up the wall until the desired amount of wall is covered with the siding. This separate interlocking piece is capable of being fastened to a wall constructed of any building material while remaining hidden within the completed assembly. The final appearance of the siding gives the illusion of full logs, the drawbacks related with their construction and settling is not experienced.

10 Claims, 9 Drawing Sheets

FIG. 1
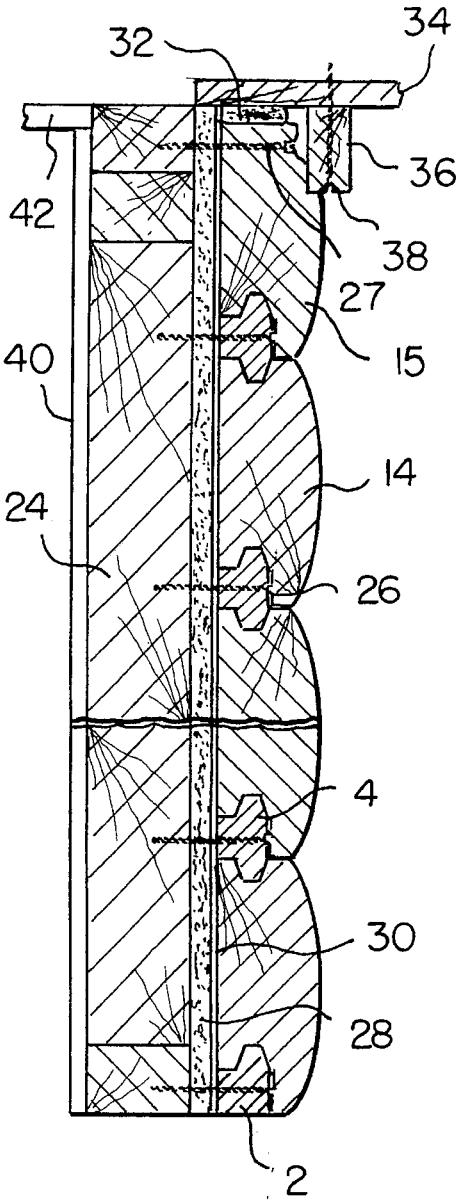
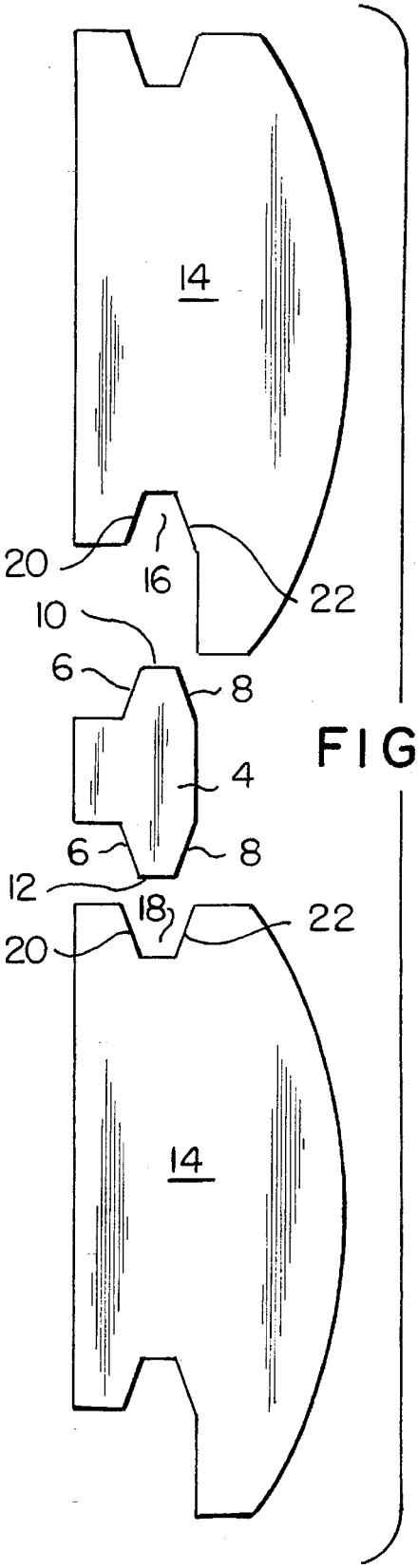
FIG. 3

HALF LOG SIDING MOUNTING SYSTEM

FIELD OF THE INVENTION

This invention relates to half log siding which can be mounted to any pre-constructed wall that is flat while providing the illusion of full log construction with extended corners.

BACKGROUND OF THE INVENTION

There has been a large number of attempts to simulate the appearance of the full log construction with the use of a siding system. Most of these attempts try to suggest that wood is no longer available or too expensive. Despite environmentalist concerns for protecting the wildlife, thus forcing reduction of usable timberlands and the unfortunate acid rain's destruction of large numbers of timber, the full log is readily available and reasonably priced in today's market. Some attempts are based on designs of using a pre-constructed wall with a chosen insulation and a wood siding being half log or less that out performs the insulating value of the full log. With the superior quality of insulating materials today, the thermal mass concept of the full log construction cannot compete in locations that experience extreme temperatures for extended periods. This lack of insulating value (R factor) with the full log can be identified in higher utility expenses. While other attempts combine stated reasons and also suggest an "easy to apply" siding method. This concept is true because any design or building code does not have to be considered and the installation can be accomplished as a simple siding procedure. Though simple enough, the considered applications are relating to pre-constructed walls consisting of and limited to wooden stud design. The intention for application to any other type of wall design is eliminated because of the method in which securing the siding to the wall is performed. Application is standard within the industry, all logs are securely mounted to the walls with the use of large nails (spikes). In recent years the introduction of a screw style nail has given better gripping power. These nails are driven directly into and through the half log then into the stud within the wall. Conveniently over looked is the damage the nails do to the studs as they penetrate. Being quite large the nails easily and frequently will split the stud severely, resulting in a dramatically weakened structure from the application. All nails are concealed by the stacking of the next row of half log siding. Decorative trim may be used around any area of the building that shows exposed cuts or needs a finished appearance. Understanding that most designs for the half log siding take into consideration for the weather, trying to keep the wind and rain out. Commonly used are tongue and groove cuts made into the logs to help provide this seal. Also widely used is a foam seal or caulk that is placed between where any two logs may join. With a variety of quality stains and sealers available today the maintenance required for a wood exterior is effectively reduced and no longer a major concern for the individuals who purchase them.

Despite the introduction of maintenance free vinyl and aluminum sidings with an arsenal of styles and colors, including imitation wood textures, the log home industry is experiencing substantial sales growth. Each year additional manufacturers and suppliers join the industry to enjoy an ever expanding market. Though the half log or insulated log wall is fairly new, the benefits and cost effectiveness of its construction are becoming quite popular and almost every supplier is offering a version of it.

The only compatible previous patent found, Kinser U.S. Pat. No. 4,277,925 Simulated Log Building Structure, will be discussed here to briefly enlighten the reader of the objectives of this patent, differences, flaws in design, and the limitations related with the application of this siding method. Kinser states that the object of his invention is to provide a prefabricated building system that when assembled gives the building the appearance of a log home that has been custom built by hand-hewing the ends of logs and caulking between adjacent logs for the log and mortar look. It is also clearly stated that this method of simulating the log and mortar is only applicable for new construction consisting of a wood studded wall and being the corner post is considered a main component of the building structure. Though the mortar spacer also later referred to as a mounting connector by Kinser was intended primarily as a decorative piece then decided to give it the duty of securing the log facing material to the wall. A nail which is illustrated or as suggested any conventional attachment means usable in the building industry to secure these elements must penetrate this mortar spacer and fasten to the wall, in doing so it is clearly noticeable that any authenticity in the custom built simulation will be lost because this in not required on such construction. Whereas the mounting system in present invention is specifically designed for the task of securely holding the large half logs in position on any pre-constructed wall that is flat and that which may be made of any building material. Remaining completely concealed within the assembly its means of fastening is not obvious, even to the skilled in the art which is a requirement with Kinser's method. Also with Kinser's method he has allowed for the natural movement in all wood products but unfortunately this movement is noticeable at the corner post made with the extensive cutting to make it appear as a real crafted dovetail notched corner assembly. The means in which this movement is noticed is by a separation of the log facing and mortar spacer at the abutting to the dovetail corner post. Again, any authenticity in this custom built assembly is lost because this is not found on log buildings. To further mark the boundaries of his invention he intentionally mentioned that this wall assembly is to be as thin as possible and obtain the R-19 insulation rating that he considers a high value and energy saving. The reality is that in today's building industry a simulated log wall easily achieves R-36 and greater values with the use of half logs and the improved insulating materials available.

OBJECTS AND ADVANTAGES a) The principal object of the present invention is to give the illusion of full log construction to buildings with the use of half log sidings.

b) It is also an object of the present invention to enable this half log siding to be applied to any type of pre-constructed wall that is flat.

c) Another object of the present invention is to allow for ease of assembly without the expertise of carpentry or construction skills.

d) Yet another object of the present invention is to strengthen the structure it is applied to while simultaneously eliminating any stress that may be otherwise experienced through the natural movement related with wood.

e) A further object of the present invention is to provide superior seals to eliminate penetration of the weather.

f) Another object of the present invention is to be cost effective for both initial installation and long term ownership.

The foregoing objects of the present invention can be accomplished with a specific method of application for the half log siding. With the utilization of a separate piece of interlocking material having a definite shape, placed on the bottom and top of each stacked half log siding, this interlocking piece can then be employed to securely hold half log siding against the applied wall. Fasteners used to retain these half log sidings to the applied wall never penetrate the logs, the final half log siding being the only exception. This interlocking piece can then be better labeled as the mounting strips which performs the task of holding the logs to the applied wall. All fasteners go directly through the mounting strips. Since the logs are merely held in place it shall be acknowledged that the half log sidings are not to be considered fastened to the applied wall thus allowed to move as they would from temperature and humidity changes and not to interfere with the stability of the applied wall. There is a mounting strip for each level of half log siding mounted to the applied wall, in doing so means there are numerous horizontal braces increasing the wall's strength. The specific shape of the mounting strip, corresponding with the cuts previously machined into the half log sidings, allows for easy assembly, stays completely concealed and does not permit the penetration of the elements. The angle of which all fasteners are installed combined with the specific shape of the mounting strips gives this method a unique advantage of being able to be applied to any wall surface that is flat. The ends of the logs are also an important area of concern for sealing properly. A unique seal is illustrated in present invention that allows for log movement, provides an excellent seal and does not show air gaps created from the logs movement. The finished assembly looks authentic as any full log construction and is economical to apply since a lesser amount of material is required and being installed onto a pre-constructed wall the owner can choose any kind and amount of insulation thus reducing utility expenses. Further objects and advantages of my invention will become apparent from a consideration of the drawings and ensuing description.

SUMMARY OF THE INVENTION

The present invention provides a superior siding arrangement and manner of applying a half log siding to any pre-constructed wall that is flat and that may consist of any building material. With the application of this siding system the illusion of full log construction is accomplished. Many benefits are appreciated resulting from the installation of present invention in relation to the full log; lower installation and maintenance expenses, lower utility expenses, older homes can be revived with new life, and in relation to other half log sidings; a stronger more stable structure, ease of installation and excellent seals are created at all the adjoining components in the system.

DESCRIPTION OF DRAWINGS

FIG. 1 is a side plan view of the assembled interlocking mounting pieces of present invention with half log siding applied to a studded wall.

FIG. 3 is an exploded side plan view of the mounting strips and half log siding.

DESCRIPTION OF THE PREFERRED EMBODIMENTS

Figure 2:
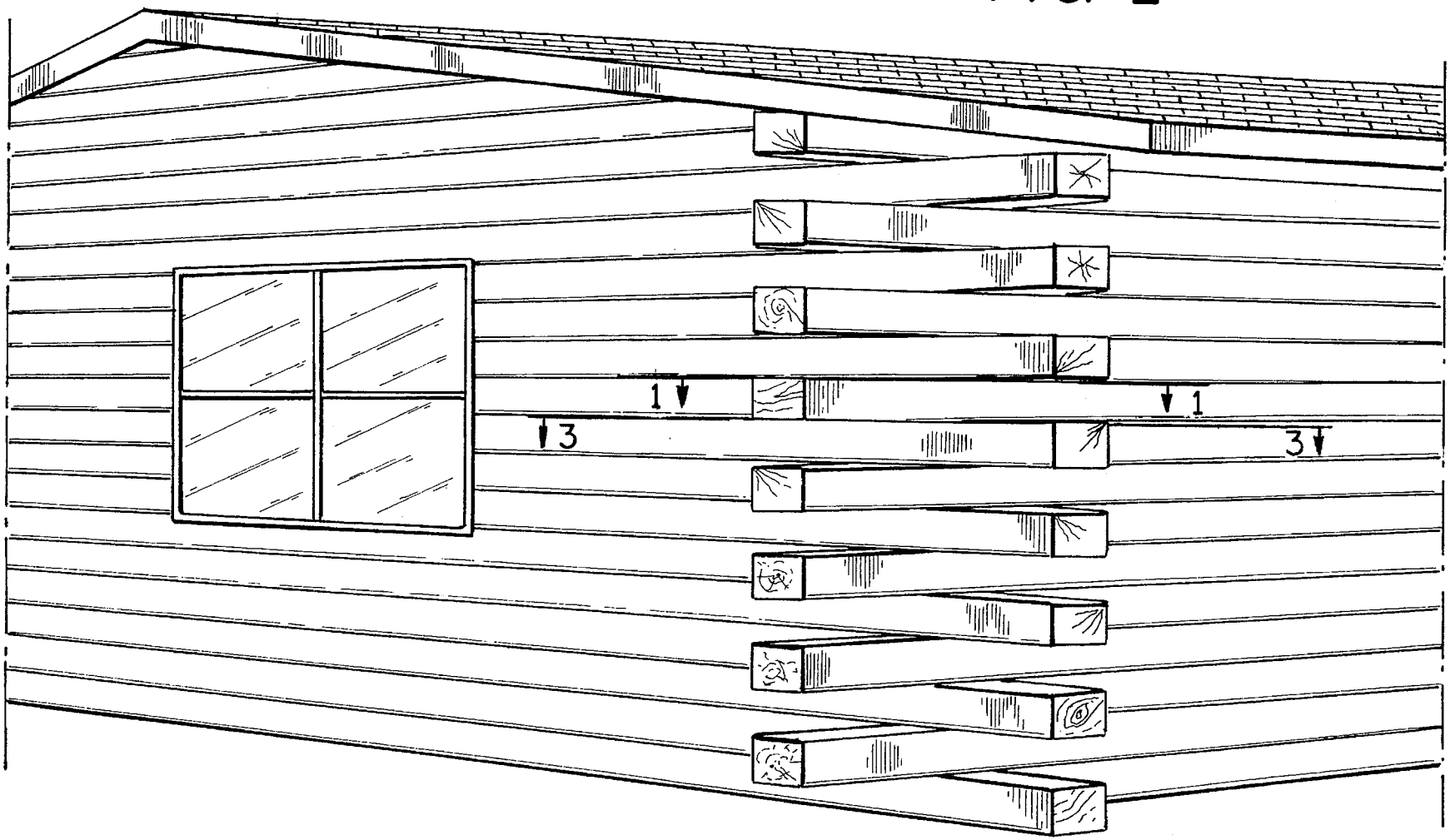
FIG. 2 is a perspective view of a front and corner of a building having the finished appearance of full log construction after application of the present invention with references of cross-sectional viewing for proper placement of siding components.

FIG. 1 shows the assembly of half log siding 14 to a pre-constructed studded exterior wall 24. The exterior wall 24 is of standard stud construction and can be commonly found on most home buildings. An exterior polystyrene foam insulation 28 is first applied to help increase the insulating abilities of the exterior wall 24. The application of an air infiltration barrier 30 over the foam insulation 28 dramatically decreases the drafts entering the exterior wall 24 and thus the building in general keeping a better controlled and more efficient environment. With the foam insulation 28 and air barrier 30 in place we are then ready to install the elements of the invention. The lower mounting strip 2 is securely mounted to the base of wall 24 with the use of a mounting screw 26. A deck screw is used for the mounting screw 26 and is preferred for a number of reasons; first is that these screws are considerably strong for their size and resist breaking, second is that the holding power of these screws is excellent and clearly out performs nails that may be used for same application, third is that the design characteristics allow for penetration while eliminating the possibility of splitting the studs within the wall (which is a problem when using nails), fourth is being of flat head design allows for them to be flush when inserted, and lastly being protective coated means that screws will not rust and that they will retain their original condition and more importantly their strength. With the lower mounting strip 2 in position, the first half log 14 can be easily placed in position due to the unique design of the mounting strips 2 and 4 which will be later explained with regards to FIG. 3. With the placement of the first piece of half log siding 14 the lower mounting strip 2 is concealed and retention of lower portion of siding 14 is accomplished. Next installed is the mounting strip 4 that is used throughout the rest of the assembly, again mounting screw 26 is used to secure mounting strip 4 which retains upper portion of half log siding 14. This assembly is repeated up the exterior wall 24 until the desired amount of half log siding is assembled or the soffet board 34 is reached. Once at the soffet board 34 the final half log siding 15 will be placed into position and secured to wall 24 with a longer mounting screw 27 that will give the same amount penetration (as screw 26) into the exterior wall 24. To provide a positive seal for the void area created at final half log 15 and soffet board 34 a foam sealant 32 is compressed into location. A decorative trim 36 is installed to beautify the final steps of assembly and again mounting screws 38 are utilized but of appropriate length which may be different from other locations previously mentioned. A standard finished interior wall 40 and ceiling 42 is shown expressing that the interior may remain original or conventional as may pertain.

With the half log siding 14 completely installed with the method of application as described in present invention using mounting strips 2 and 4 the building can easily be mistaken for a full log constructed building for there are no obvious indications that it is constructed otherwise. This completed assembly is presented in FIG. 2.

Figure 4:
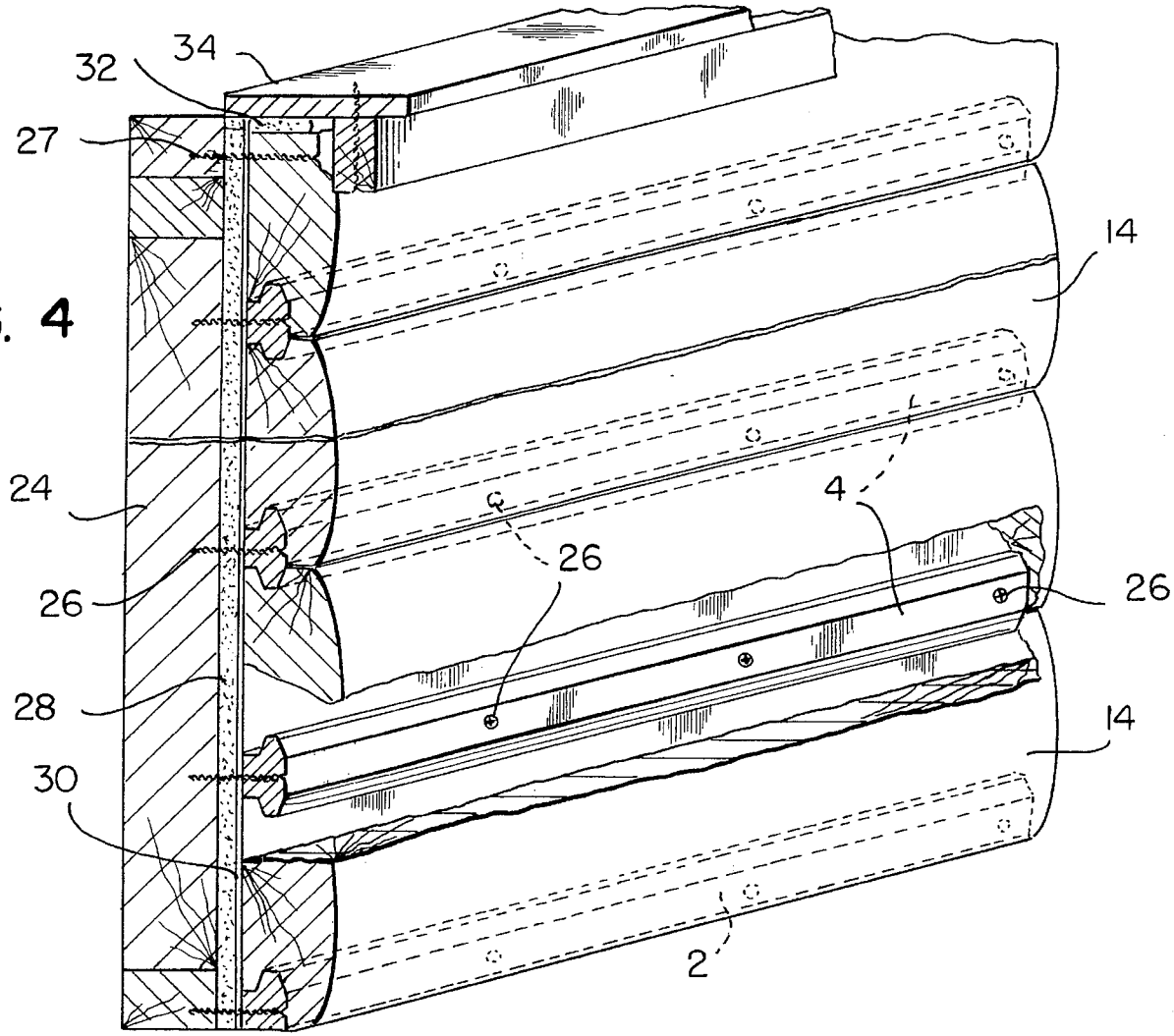
FIG. 4 is a perspective view of the half log siding assembled on a wall with the use of interlocking mounting strips screwed to a typical studded wall.

The elements utilized for the assembly of this system is unique for reason being that it allows for easy assembly while providing maximum holding power. The concealed interlocking material considered as mounting strip 4 is named for the particular function it is designed for. The specific shape of this mounting strip 4 (also 2 being the lower mounting strip) is described here in detail and the relationships are shown in FIG. 3. There are two tongues considered the upper locking tongue 10 and the lower locking tongue 12 (only the upper locking tongue 10 is present on lower mounting strip 2) that are designed in such a way as to allow for any slight imperfections with the flatness of a wall. Surfaces being inner diagonally cut edges 6 of mounting strip 4 and inner diagonal cut of dado in half log siding 21), when being assembled present initially a larger amount of room to place pieces together. This can be noted when placing lower tongue 12 of mounting strip 4 in accepting upper dado cut 18 in half log siding, or upper locking tongue 11) of mounting strip 4 accepting lower dado cut 16 in half log siding. As either piece is brought closer to being considered a proper fit diagonal cuts previously mentioned along with outer diagonally cut edge 8 of mounting strip 4 and outer diagonal cut 22 of dado in half log siding help align pieces of the assembly for an easily accomplished, tight, well mated join. When applied to a conventional studded wall as shown being fastened to exterior wall 24 in FIG. 4 the mounting screws 26 are placed so to penetrate studs within the wall which is common to be either 16 inches or 24 inches on center of each other. When mounting screws 26 are placed on each stud in exterior wall assembly 24 maximum holding power is obtained. A major benefit from securing at each point possible through mounting strips 4 is that with the network of horizontal braces formed from the repeated assembly of mounting strips 4 and half log siding 14 up the exterior wall 24 a dramatically stronger structure is created.

Figure 5:
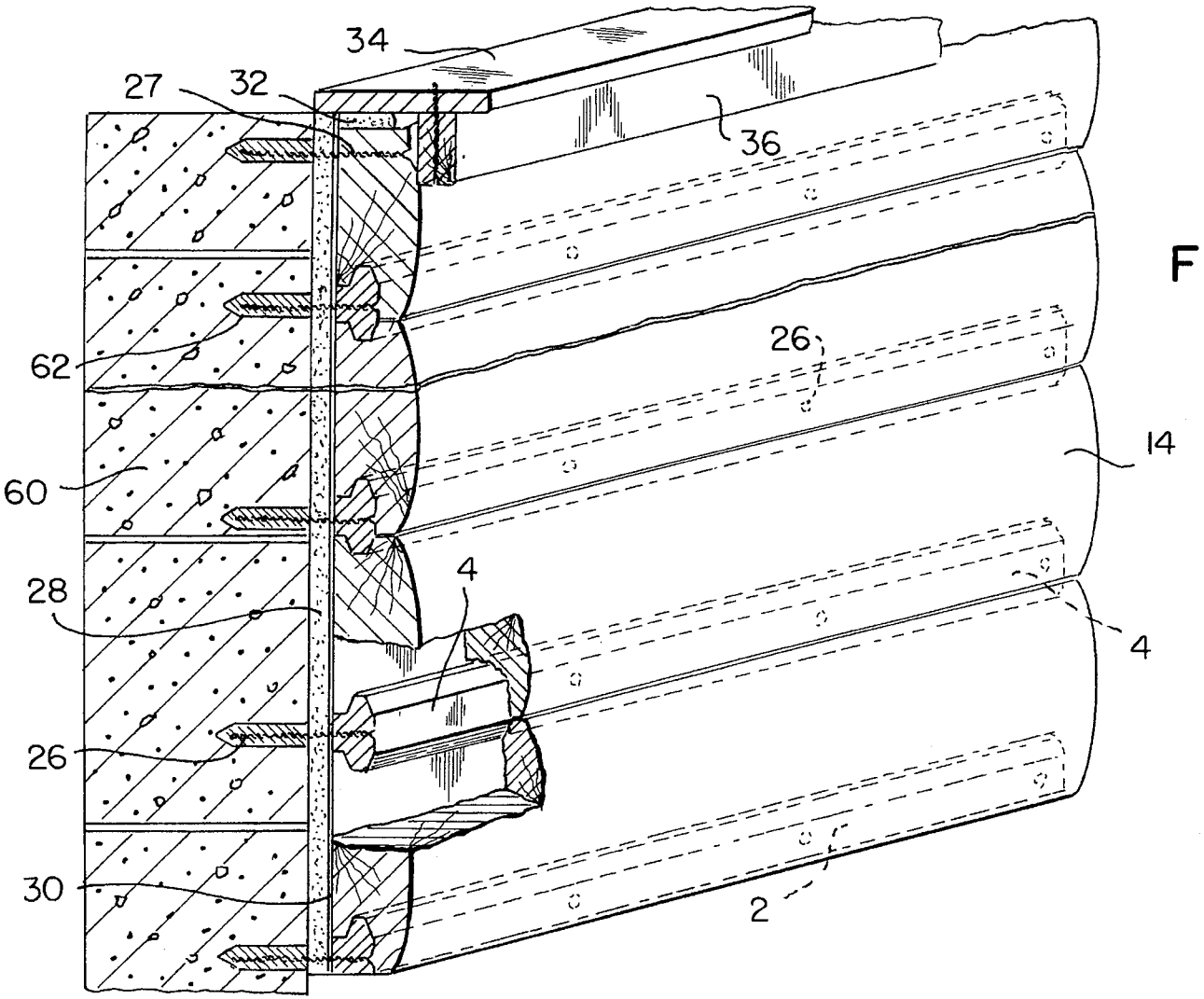
FIG. 5 is a perspective view of the half log siding assembled on a wall constructed of either block, brick or stone and the interlocking mounting strips used with anchors to firmly secure screws to wall.

Versatility is another major benefit from using mounting strips 2 & 4. It can be realized in observation of FIG. 5 which demonstrates the application of half log siding 14 to an existing block wall 60. The task of applying a half log siding to other than a conventional studded wall has been avoided because current designs do not allow for this to be easily accomplished. The application onto solid surfaces such as block, brick or stone is achieved with little extra effort of pre-drilling the locations for mounting screws 26 & 27 and inserting anchors 62 which securely retains mounting screws 26 & 27 and thus mounting strips 2 & 4 will also be securely fastened in place which will perform the duties of holding half log siding 14 in position.

Figure 6:
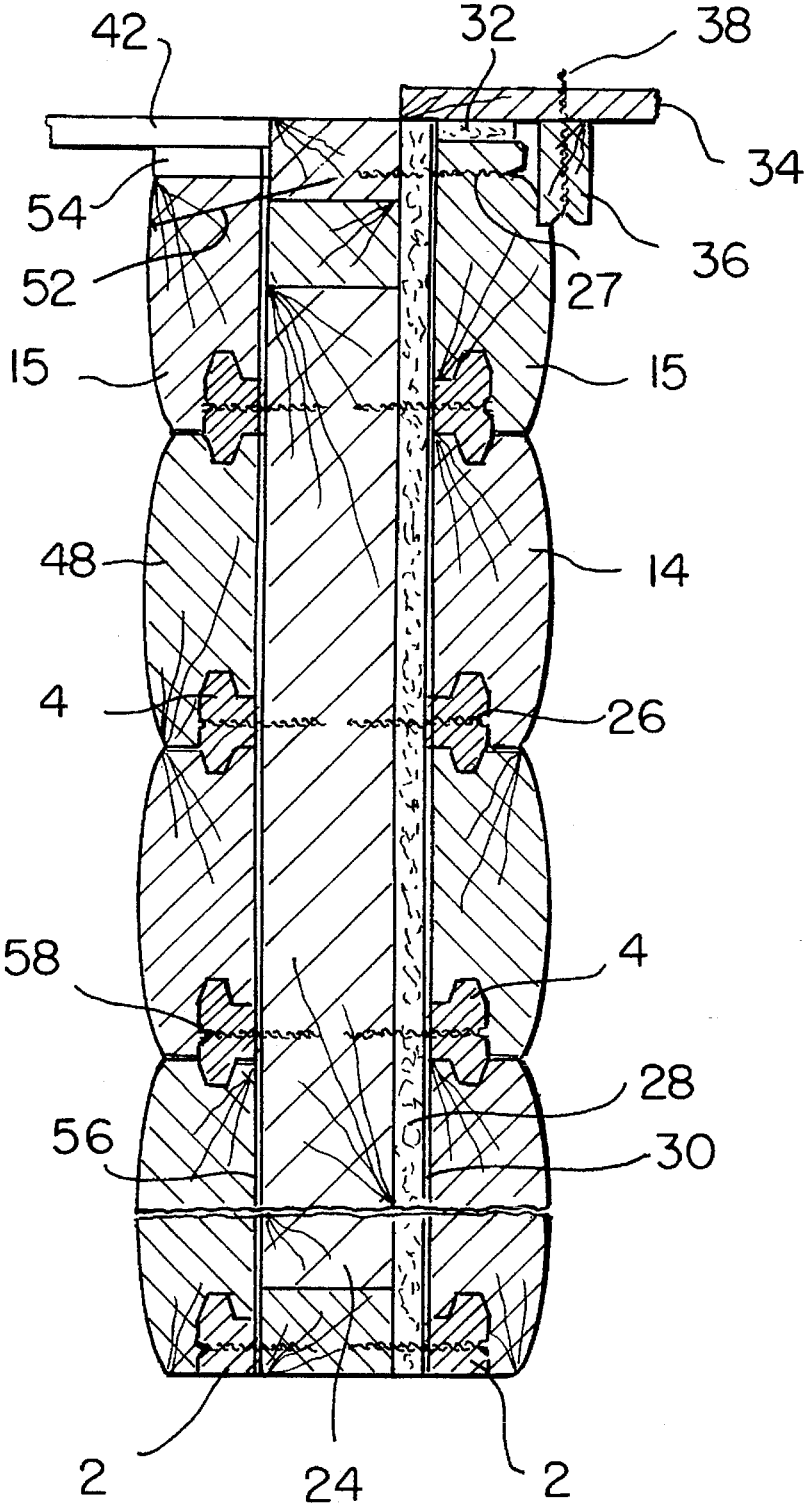
FIG. 6 is a side plan view of the present invention also applied to the interior wall and the elements of the present invention shown in their proper placement.

This siding system is also capable of being applied to any interior wall and can be recognized in FIG. 6 as an interior half log siding 48. There are no significant differences with the interior application as compared to the exterior application, however, mounting screw 58 will be of appropriate length and will not be the same length as either mounting screw 26 or 27 because no insulation or other type of board needs to be placed over the exposed studs. If half log siding 14 is to be applied to the inside of an exterior wall 24 it is necessary that a vapor barrier 56 be installed prior to avoid problems from humidity later on. At the top of the assembly the final half log siding 15 is secured with finishing nails 52 and will not be seen. It may be noted that if the desired amount of wall to be covered with half log siding 14 is not dimensionally correct that final top log 15 can and may be trimmed to meet height limitations. To fill the void created with the placement of final half log siding 15 and the ceiling 42 a bead of caulk sealant 54 can be used, or may be finished similar to the exterior by installing a decorative trim 36.

Figure 7:
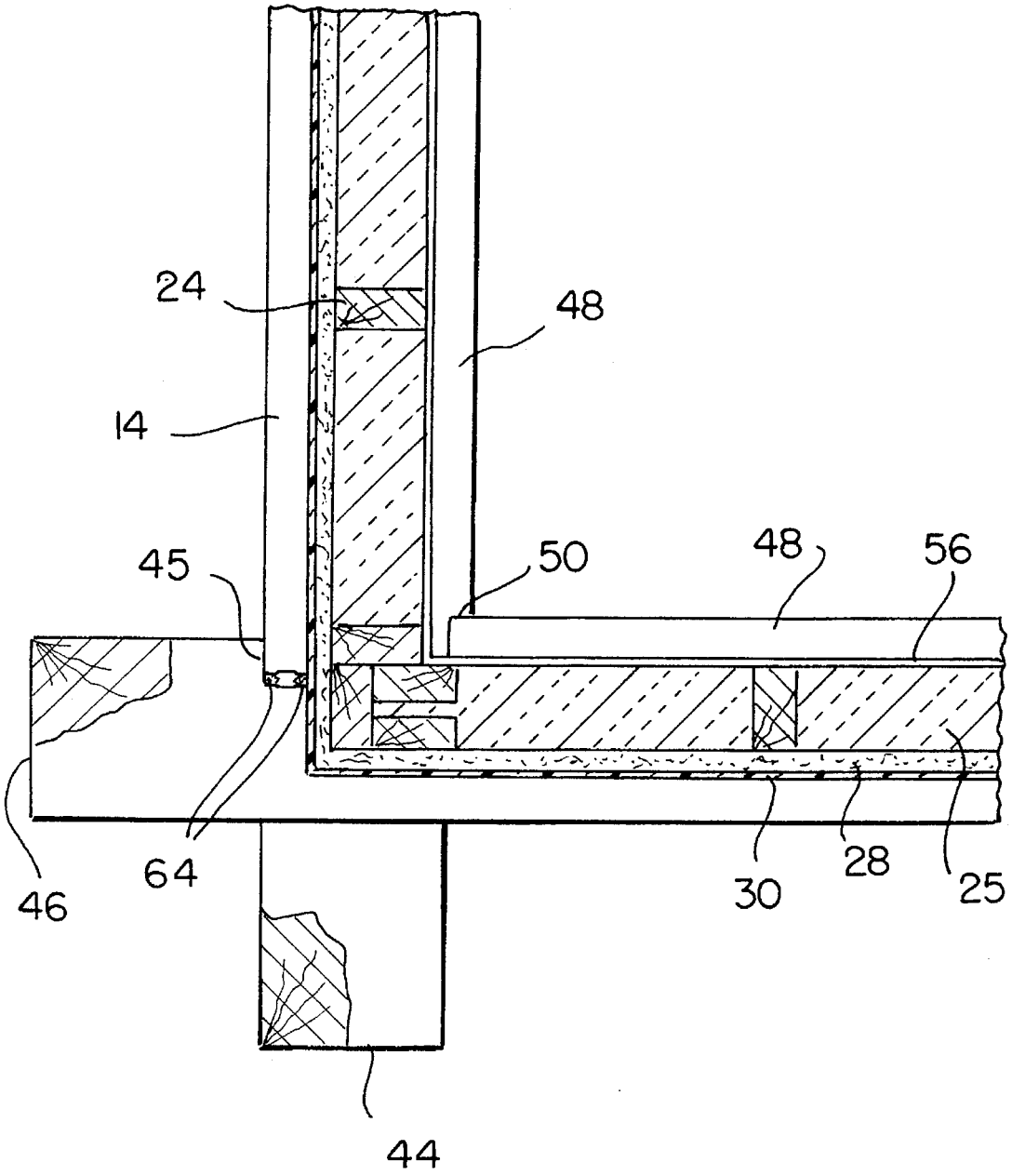
FIG. 7 is a view in detail of the portion indicated by the section lines 1—1 in FIG. 2, the half log siding shown meeting a left corner half log siding at the corner, there also being shown the dado fit and double seal used in the installation of this siding system. Also shown is the placement of the half log siding for the interior wall.
Figure 8:
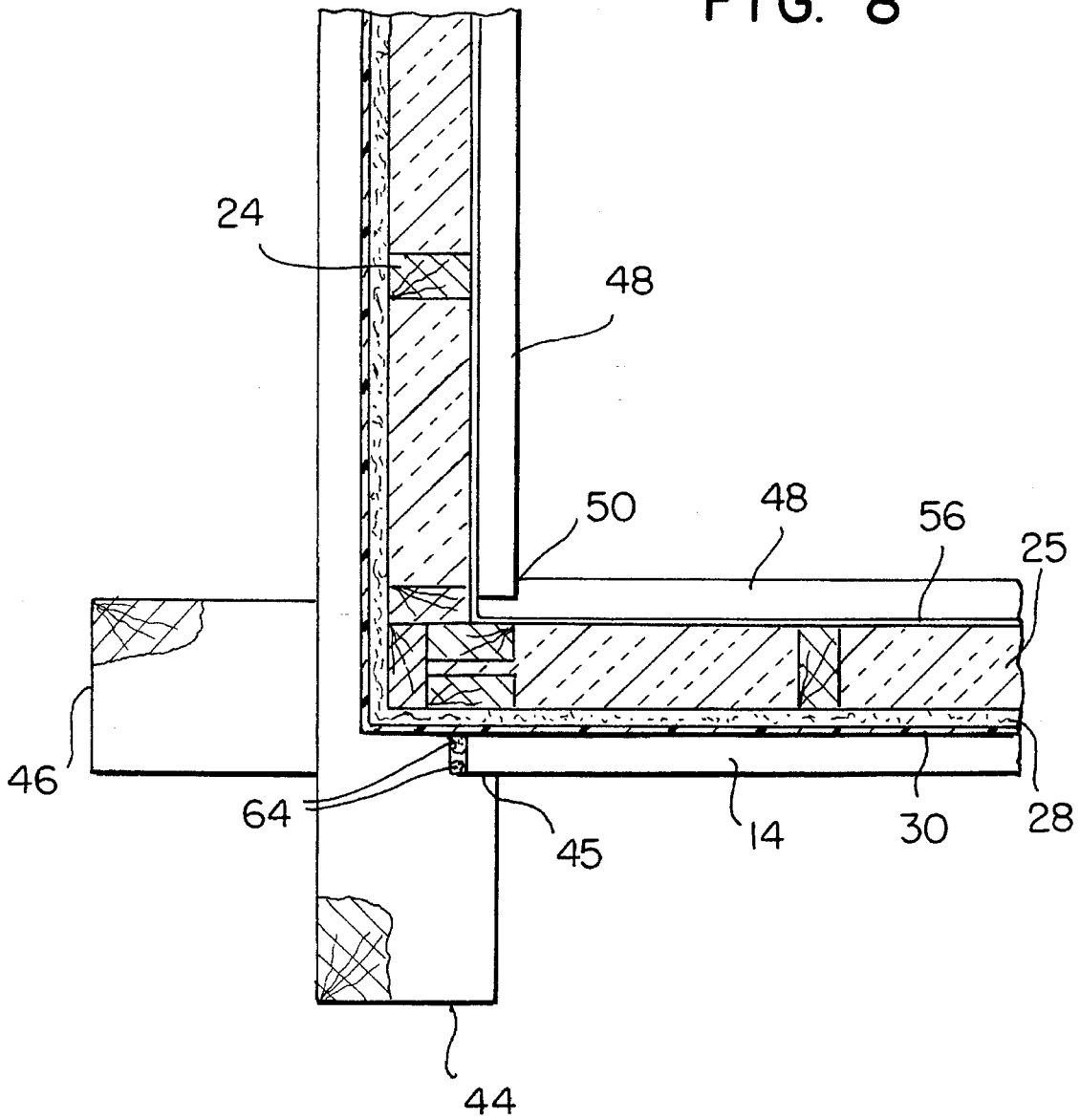
FIG. 8 is a view in detail of the portion indicated by the section lines 3—3 in FIG. 2 being the half log siding is shown meeting the right corner half log siding at the corner displaying the dado fit that opposite of FIG. 7 which is how the half logs give the alternating stacked full log appearance. Also shown is the placement of the half log siding for the interior wall.

With reference to cross sectional lines 1—1 and 3—3 of FIG. 2 the alternating stacked corner appearance can be better interpreted by looking at FIG. 7 and FIG. 8 for details. First it must be noted that corner half log sidings (44 & 46) are an extension of a half log siding 14 and the method of mounting corner half log sidings (44 & 46) is exactly the same as for half log siding 14. This can be realized in FIG. 7 and FIG. 8. In FIG. 7 a left hand corner half log 46 is shown placed in the corner of exterior wall assembly 24 with a half log siding 14 meeting same at dado 45. Placed within this dado 45 is a double seal of rubberized adhesive butyl sealant 64 that makes for an exceptional seal that is capable of being remarkably flexible with log movement and stay in tact with both surfaces it is placed between. This dado serves yet another purpose which is to conceal the joint between corner half log siding (left 46 or right 44) and half log siding 14, and the double butyl seal 64. As natural log movement occurs any gaps may become larger and be considered undesirable as well as unsightly. This dado 45 eliminates this dilemma as any log movement is contained within the dado 45. Also shown in FIG. 7 is how the interior half log siding 48 is properly fitted in the corner area. FIG. 8 is the exact opposite of FIG. 7 and this illustrates how an alternating stacked corner is accomplished and the inner appearance of the same.

Figure 9:
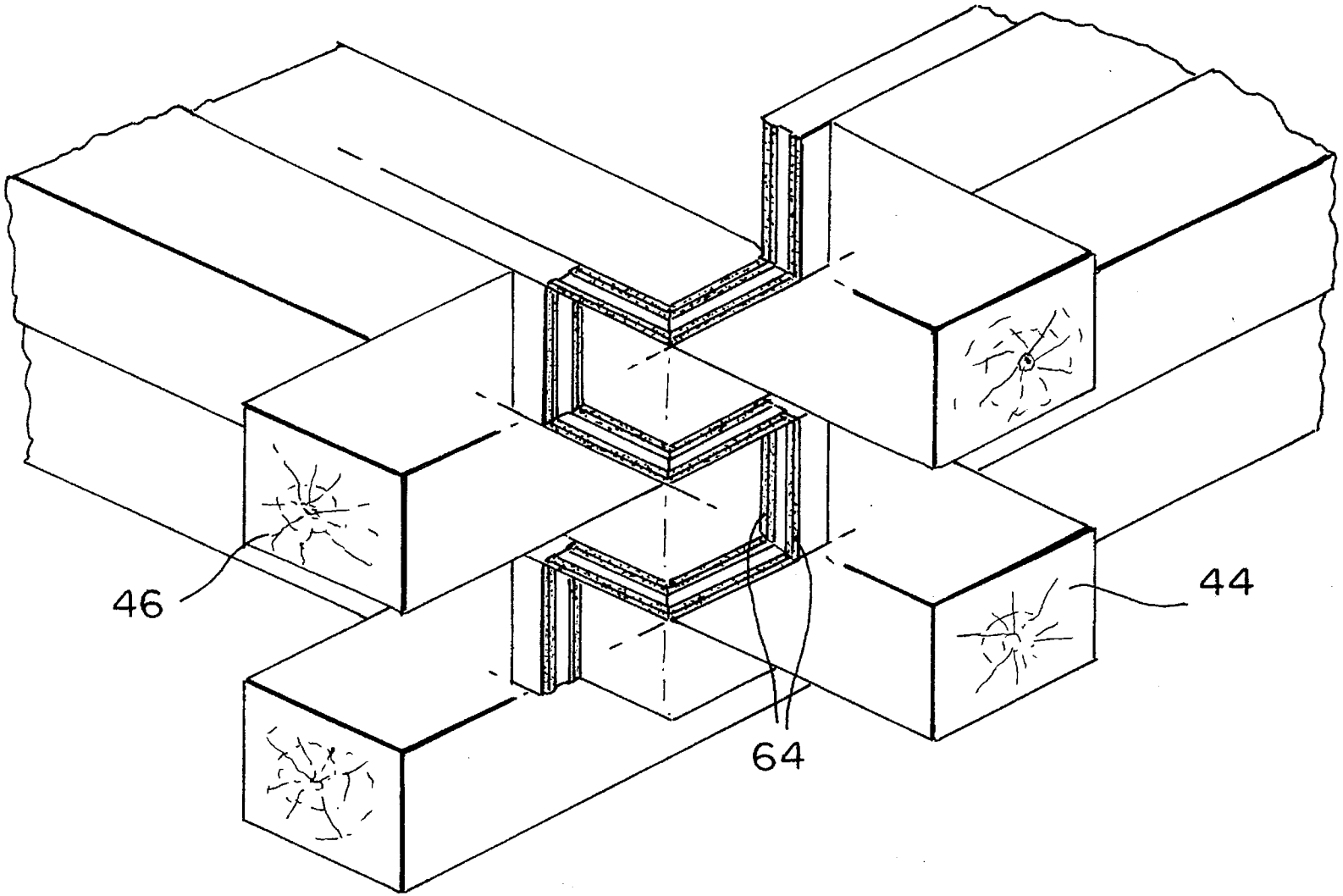
FIG. 9 is an inside perspective view of an assembled half log corner section depicting placement of the double seal consisting of rubberized adhesive butyl sealant.

Tight seals are a must at all corners which is the most likely area to allow for penetration of the weather. FIG. 9 exhibits the same double seal 64 that was shown in FIG. 7 & 8 but in full perspective. This double seal 64 completely wraps around all joining areas of both corner half log sidings 44 & 46 thus capable of providing the superior seal necessary to completely eliminate any possibility for the penetration of the weather elements.

Figure 10A:
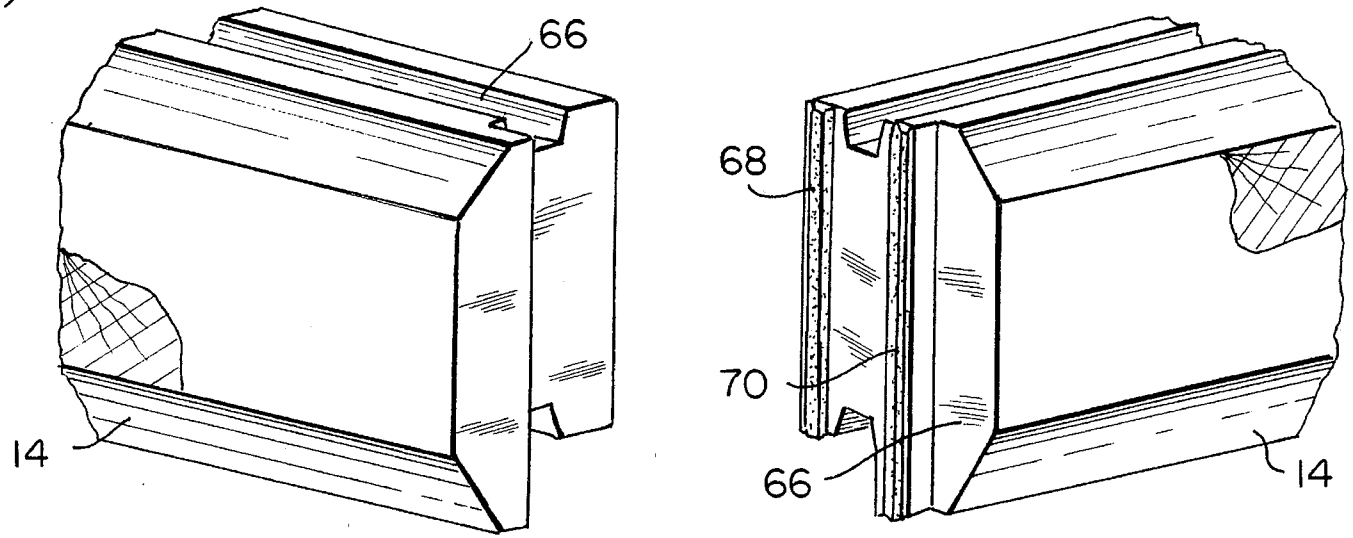
FIGS. 10*a* and 10*b* are respective fragmentary perspective and top plan views showing the ship lap method of making the union and the placement of the double seal for abutting half log sidings.
Figure 10B:
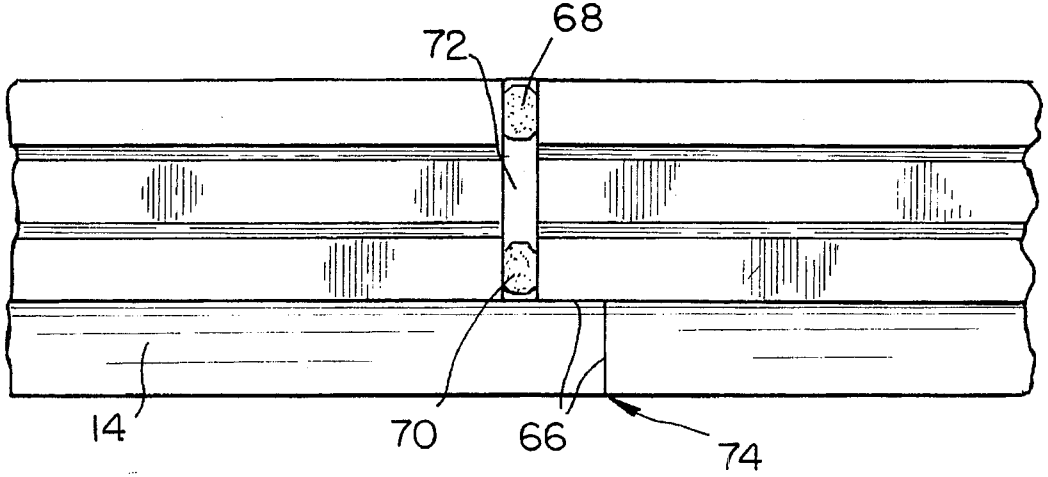

The abutting half logs 14 is also of concern for proper sealing. With a long length of wall it would be impossible to cover this length with one log. There may be two or more half log sidings 14 added to the corner half log sidings 44 & 46 and thus a large number of unions would be made on the side of a building. With so many possibilities for the weather to penetrate it is of major concern that a high quality seal be made. FIG. 10*a* shows two adjacent ends of adjacent abutting half logs 14 which are provided with the ship lap cuts 66, inner seal 68 and outer seal 70 made of the same rubberized adhesive butyl sealant used in alternating stacked corner assembly shown in FIG. 9. FIG. 10*b* shows the FIG. 10*a* adjacent log ends in longitudinal assembled relationship. The separation of the inner and outer seals (68 & 70) creates an effective thermal barrier with air pocket 72. It is a known fact that a "dead air space" makes for a good insulator as air by itself does not conduct temperature well at all. Also incorporated into this union of the half log siding 14 is an offset made with the ship lap cuts 66 and thus when half log siding 14 goes through its natural movement from the experienced temperature and humidity changes visual gap 74 will not allow for a large air gap to be seen but for the half log siding 14 itself, thus making for the gap not to appear obvious.

It is seen that this method of applying the half log siding is economical for short and long term, beneficial, that special skills are not required, and will most effectively give the illusion of a solid log constructed building having an alternating stacked corner while being applicable for whatever type of wall chosen to apply siding to.

The composition of mounting strips 2 & 4 can be of any material that would satisfactorily perform the duties explained herein and that also would not have to be solid in form but can be of any material that would allow for the specific shape and rigidity to be acquired. This specific shape being defined as having a progressive shape so designed to allow for easy assembly of the elements relating to the siding application while providing a tight precision fit.

In relation to this method of applying the half log siding; it shall not be limited to only the half log but where may be applied to other thickness' of the log such as quarter log, or if a simulated log made from other than wood may be used and applied. The dimensions of the elements used in present invention need not be discussed as there should be no limitation on size or proportion of the elements.

The final appearance of the illustrated embodiment is of alternating stacked corner design, however, this method of application using elements of the invention can be utilized on any extended corner design or if no corner extension is desired. Being more explicit, this half log siding system is capable of being utilized for any type of siding that would benefit from the advantages related directly from its use.

While my above description contains many specificity's, these should not be construed as limitations on the scope of the invention, but rather as an exemplification of one preferred embodiment thereof.

Accordingly, the scope of the invention should be determined not by the embodiment(s) illustrated, but by the appended claims and their legal equivalents.

I claim as my invention:

1. In a building wall structure, a siding system covering an expanse of a wall of said structure, said siding system comprising vertical rows of horizontally disposed elongated siding pieces, a siding piece in any given row being fixed against said wall with a mounting strip extending longitudinally coextensive with the siding piece and having a top locking tongue received loosely in a lower face groove of said siding piece, said mounting strip having a bottom locking tongue received loosely in an upper face groove of a siding piece in a row next below said given row and said mounting strip fixing said next below row siding piece against said wall, said given row siding piece having a front facing side provided with generally straight lowermost edge that lies in abutment with a generally straight uppermost edge of a front facing side of said next below row siding piece, the lower face groove of said given row siding piece and the upper face groove of said next below row siding piece being located rearwardly of the respective front facing sides of said given row siding piece and next below row siding piece whereby said mounting strip is fully concealed from view behind the said respective front facing sides.

2. The building wall structure of claim 1 in which the horizontally disposed siding pieces are configured in section as half log pieces.

3. The building wall structure of claim 1 in which the mounting strip is secured to the wall with mechanical fasteners, the mechanical fasteners passing through only portions of the mounting strip.

4. The building wall structure of claim 3 in which the wall of said structure includes frame members, the mechanical fasteners being fastened into said frame members.

5. The building wall structure of claim 3 in which the wall of said structure presents a solid expanse, the mechanical fasteners beings fastened into fastening anchors mounted in the solid expanse.

6. The building wall structure of claim 1 in which the locking tongues of said mounting strip, and the upper and lower face grooves of the siding pieces have complementally configured cross sections.

7. The building wall structure of claim 6 in which the locking tongues of the mounting strip and the upper and lower face grooves of the siding pieces have cross section configurations which include matching tapers.

8. The building wall structure of claim 7 which the upper and lower face grooves of the siding pieces are configured with dado cross sections.

9. The building wall structure of claim 1 comprising another siding piece in said given row longitudinally aligned with the first-mentioned siding piece, adjacent ends of said another other and said first-mentioned siding piece having a ship lap cut so that a part of the front of one siding piece end is in joint overlap with a part of the front of the other, tips of the adjacent ends behind said front parts being spaced one from the other, there being seals carried in the spacing between said tips which define a dead air space at said joint.

10. The building wall structure of claim 1 further comprising another wall located adjacent the first-mentioned wall, said another wall having an expanse which is covered with vertical rows of horizontally disposed elongated siding pieces, said another wall having disposition relative to the first-mentioned wall such that end parts of siding covering said another wall have crossing intersection with end parts of the siding covering the first-mentioned wall, there being flexible seal means interposed between surfaces of the end parts of siding covering said another wall and surfaces of the end parts of the siding covering said first-mentioned wall where said surfaces are crossing one with another.

* * * * *